US009314075B2

(12) United States Patent
Sparks

(10) Patent No.: US 9,314,075 B2
(45) Date of Patent: Apr. 19, 2016

(54) BABY CHANGING STATION AND STORAGE BAG

(71) Applicant: Candace Sparks, Ocean Springs, MS (US)

(72) Inventor: Candace Sparks, Ocean Springs, MS (US)

(73) Assignee: Candace L. Sparks, Apo, AP (US)

( * ) Notice: Subject to any disclaimer, the term of this patent is extended or adjusted under 35 U.S.C. 154(b) by 90 days.

(21) Appl. No.: 13/750,738

(22) Filed: Jan. 25, 2013

(65) Prior Publication Data

US 2014/0037230 A1 Feb. 6, 2014

Related U.S. Application Data

(60) Provisional application No. 61/591,771, filed on Jan. 27, 2012.

(51) Int. Cl.
*A45C 3/00* (2006.01)

(52) U.S. Cl.
CPC . *A45C 3/001* (2013.01); *A45C 3/00* (2013.01); *A45C 2200/20* (2013.01)

(58) Field of Classification Search
CPC .. A47C 21/022; A47C 21/026; A47C 31/105; Y10T 24/23; A47G 9/02; A45C 3/001; A45C 3/00; A45C 2200/20
USPC ..... 383/38, 40; 5/485, 658, 503.1; 297/188.01, 188.122, 188.2, 188.21
See application file for complete search history.

(56) References Cited

U.S. PATENT DOCUMENTS

| | | | | | |
|---|---|---|---|---|---|
| 3,503,391 | A | * | 3/1970 | Melges | 128/852 |
| 3,922,973 | A | * | 12/1975 | Sturgeon | 108/26 |
| 3,967,666 | A | * | 7/1976 | Farrar | 383/7 |
| 4,154,323 | A | * | 5/1979 | Sneider | 190/2 |
| 4,566,130 | A | * | 1/1986 | Coates | 383/15 |
| 4,685,559 | A | * | 8/1987 | Titus | 206/38 |
| 4,702,378 | A | * | 10/1987 | Finkel et al. | 206/581 |
| 4,781,277 | A | * | 11/1988 | Lim | 190/1 |
| 4,873,734 | A | * | 10/1989 | Pollard | 5/425 |
| 4,877,128 | A | * | 10/1989 | Strickland | 206/170 |
| 5,279,009 | A | * | 1/1994 | Putka, Jr. | 5/485 |
| 5,438,719 | A | * | 8/1995 | Anthony | 5/485 |
| 5,439,154 | A | * | 8/1995 | Delligatti | 224/601 |
| 5,581,829 | A | * | 12/1996 | Lee | 5/503.1 |
| 5,605,235 | A | * | 2/1997 | Johnson | 211/26.1 |
| 5,732,914 | A | * | 3/1998 | Flinn | 248/201 |
| 5,743,649 | A | * | 4/1998 | Gonzalez | 383/6 |
| 5,758,972 | A | * | 6/1998 | Mack et al. | 5/503.1 |
| 5,868,227 | A | * | 2/1999 | Garcia | 190/112 |
| 5,911,472 | A | * | 6/1999 | Toth | 297/188.2 |
| 5,938,336 | A | * | 8/1999 | King | 383/4 |
| 5,961,216 | A | * | 10/1999 | Quinn et al. | 383/4 |
| 5,988,879 | A | * | 11/1999 | Bredderman et al. | 383/13 |
| D418,295 | S | * | 1/2000 | Verhulst | D3/283 |
| 6,168,022 | B1 | * | 1/2001 | Ward et al. | 206/581 |
| 6,178,574 | B1 | * | 1/2001 | Stromatt et al. | 5/485 |

(Continued)

*Primary Examiner* — Jes F Pascua
*Assistant Examiner* — Peter Helvey

(57) ABSTRACT

A baby changing station for storing and organizing baby supplies has been developed. The station includes a quilted storage bag with a central storage compartment, multiple storage pockets attached to the front and two insulated bottle holders attached on the sides. Additionally, two loops attached to each end of the storage bag so that a carrying strap may be used. The station also includes a flap for closing the storage bag. The flap is elongated and suitable for holding the storage bag in position when it is inserted in between a bed mattress and bed box spring.

1 Claim, 2 Drawing Sheets

(56) References Cited

U.S. PATENT DOCUMENTS

| | | | | |
|---|---|---|---|---|
| 6,292,963 | B1 * | 9/2001 | Couture | 5/503.1 |
| 6,298,993 | B1 * | 10/2001 | Kalozdi | 206/581 |
| 6,427,839 | B1 * | 8/2002 | Helfer-Grand | 206/494 |
| 6,594,836 | B1 * | 7/2003 | Everson et al. | 5/485 |
| 6,601,250 | B1 * | 8/2003 | Taylor | 5/485 |
| 6,763,986 | B2 * | 7/2004 | Santos et al. | 224/585 |
| D501,602 | S * | 2/2005 | Karlsson et al. | D3/287 |
| 6,848,132 | B1 * | 2/2005 | Dale | 5/503.1 |
| 6,854,139 | B2 * | 2/2005 | Lamy | 5/485 |
| D510,188 | S * | 10/2005 | Cunningham | D3/287 |
| 7,131,152 | B2 * | 11/2006 | Wootten et al. | 5/485 |
| 7,284,791 | B1 * | 10/2007 | Wright | 297/188.18 |
| D559,541 | S * | 1/2008 | Clark | D3/245 |
| 7,389,897 | B2 * | 6/2008 | Pistiolis et al. | 224/158 |
| D581,194 | S * | 11/2008 | Poteat | D6/606 |
| D611,742 | S * | 3/2010 | Bonatz | D6/303 |
| 7,761,944 | B2 * | 7/2010 | Skophammer | 5/655 |
| 7,797,774 | B1 * | 9/2010 | Beyert | 5/655 |
| 7,945,977 | B1 * | 5/2011 | Tucker | 5/493 |
| 8,047,375 | B1 * | 11/2011 | Hartsfield | 206/581 |
| D657,142 | S * | 4/2012 | Reinhart | D3/266 |
| 8,185,987 | B2 * | 5/2012 | Keehfus | 5/658 |
| 8,251,113 | B2 * | 8/2012 | Baxter | 150/104 |
| 8,267,260 | B2 * | 9/2012 | Zhang et al. | 211/118 |
| 8,490,230 | B2 * | 7/2013 | Rovin | 5/655 |
| 2002/0018601 | A1 * | 2/2002 | Nelson | 383/7 |
| 2004/0129357 | A1 * | 7/2004 | Soto | 150/112 |
| 2007/0113338 | A1 * | 5/2007 | Remblad | 5/420 |
| 2007/0122066 | A1 * | 5/2007 | Landay | 383/16 |
| 2007/0151895 | A1 * | 7/2007 | Patterson | 206/581 |
| 2008/0272160 | A1 * | 11/2008 | Vou Vakis | 224/155 |
| 2009/0158527 | A1 * | 6/2009 | Skophammer | 5/655 |
| 2010/0116859 | A1 * | 5/2010 | Dessou-Tzafrir et al. | 224/409 |
| 2010/0226596 | A1 * | 9/2010 | Lee | 383/8 |
| 2010/0269259 | A1 * | 10/2010 | Campbell | 5/498 |
| 2011/0097017 | A1 * | 4/2011 | Abrams | 383/40 |
| 2011/0110611 | A1 * | 5/2011 | Apple | 383/40 |

* cited by examiner

BABY CHANGING STATION AND STORAGE BAG

CROSS-REFERENCE TO RELATED APPLICATIONS

This application claims priority from U.S. Provisional Patent Application No. 61/591,771 that was filed on Jan. 27, 2012.

FIELD OF THE INVENTION

The invention relates generally to a changing station for infants and organizational tool for related supplies.

BACKGROUND ART

Mothers of new born infants that often have a difficult time storing and retrieving baby products when carrying or changing the infant at the same time. This is especially true when the new mother is on bed rest from a Caesarean surgery or the like. Most baby product organizers are not labeled for proper storage components. A variety of baby organizers are designed to be located on the nightstand or is its own entity in the bedroom, which often causes clutter. Other products that are similar do not cater to mother's organizational tools for babies. Therefore, there is a need for a device that is designed convenient storage of baby products that is strategically designed for heavier items to be placed in pockets without slippage.

SUMMARY OF THE INVENTION

In some aspects, the invention relates to an apparatus for storing and organizing infant care supplies, comprising: a quilted storage bag with a central storage compartment; multiple storage pockets attached to the front of the storage bag that have elastic openings; two insulated bottle holders attached to each end of the storage bag; two loops attached to each end of the storage bag, where the loops are suitable for attaching to a carrying strap; and a flap for closing the storage bag, where the flap is elongated and suitable for holding the storage bag in position when inserted in between a bed mattress and bed box spring.

Other aspects and advantages of the invention will be apparent from the following description and the appended claims.

BRIEF DESCRIPTION OF DRAWINGS

It should be noted that identical features in different drawings are shown with the same reference numeral.

1. Changing station comprised of durable quilted fabric and/or waterproof quilted fabric and/or cloth material and fabric thread made and elastic. Made in various colors (Ref: 8 and drawing 1, 2)
2. Pockets made of durable quilted fabric made in various colors. For sizes see (Ref: 6, Ref: 13)
3. Embroidered Fabric thread labels for pockets. (Ref: 3, Ref: 11)
4. Non-slip Foam/Sponge inserts comprised of Polyurethane foam and/or other variations of foam. (Ref: 1, Ref: 12)
5. Elastic holder comprised of elastic and thread (Ref: 4, Ref: 15)

6. Raised logo comprise of fabric thread, ink, cloth. Ref: 10, 9, 5)
7. Thermal bottle holder comprised of thread, durable quilted fabric, thermal insulation (Ref: 2, 14, 7)
8. Changing Pad is comprised of durable quilted fabric and/or waterproof quilted fabric and/or cloth material and fabric thread made and elastic. Made in various colors (Ref. 17, 18)

Figure 1:
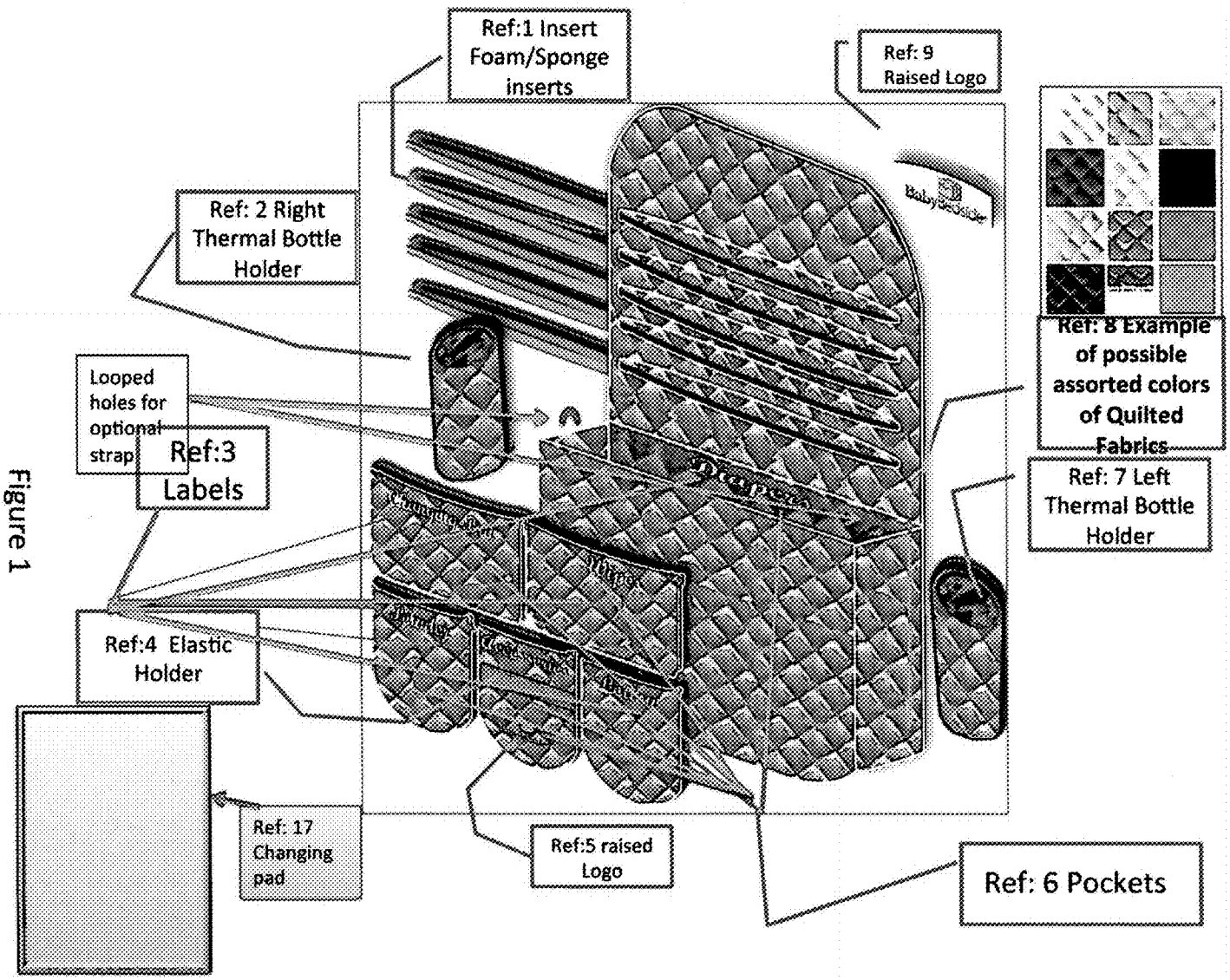
FIG. 1 shows a view of one embodiment of the present invention.
Figure 2:
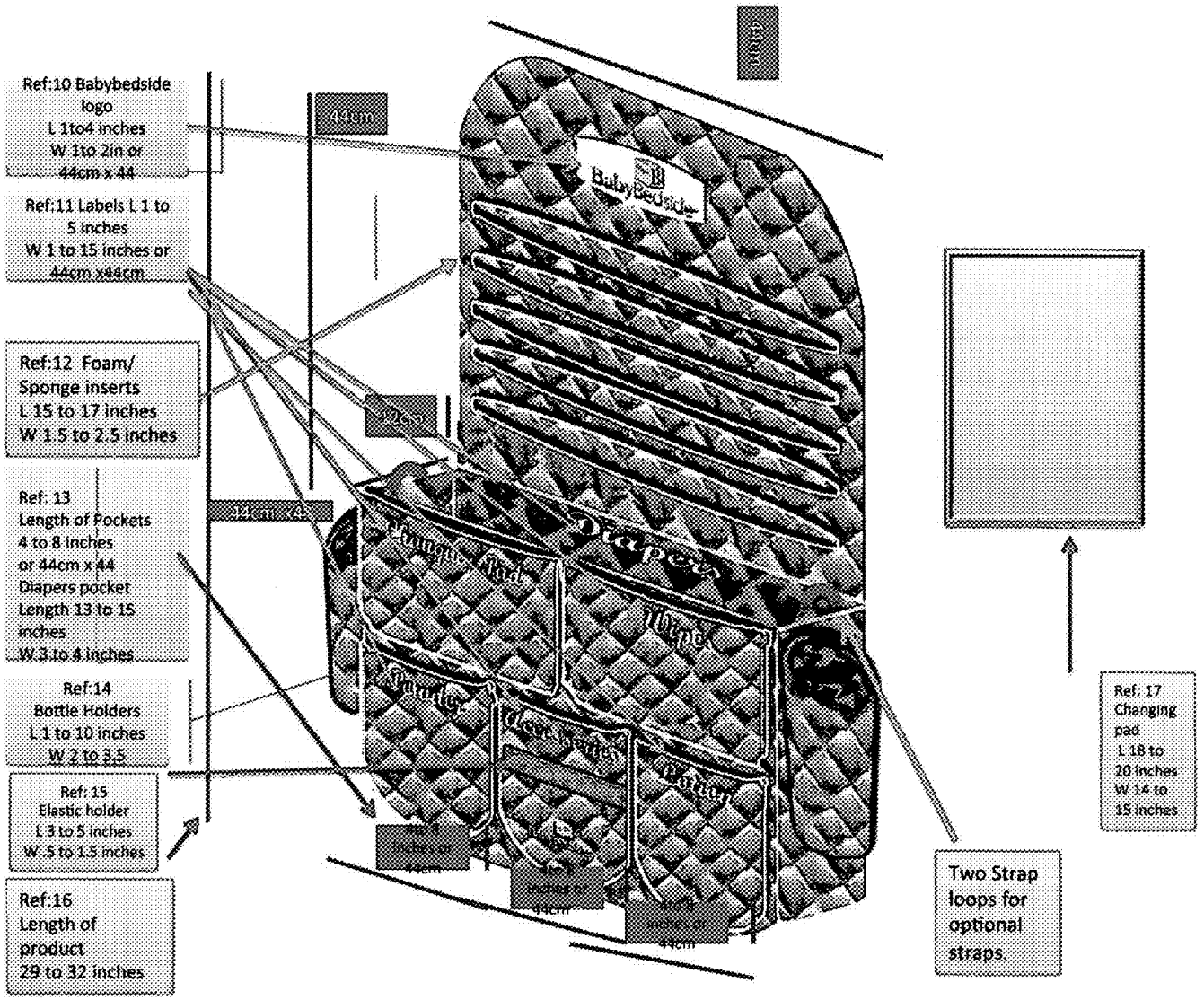

FIG. 2 shows an exploded view of the embodiment of the present invention shown in FIG. 1.

DETAILED DESCRIPTION

Bed changing station/baby organizer is designed to be place between mattresses and box spring of mattress. After placement between mattresses, proceed to fill pockets with necessary materials such as but not limited to: powder, grooming clippers, diapers, baby wipes and baby bottles. To properly use baby changing station and organizational tool to change infant/toddler: Retrieve changing pad from changing pad pocket. Place changing pad on the bed. Place infant/toddler on bed. Take out diaper, wipes and powder from labeled pockets. Change infant/toddler on changing pad. Insert products back in labeled pockets. Changing station can also double as to go baby changing station and organizational tool by adding additional straps.

This present invention has the following advantages and features: unique flap designed for non-slippage; labeled pocket components for most baby items needed for mothers; insulated baby bottle pockets that can keep bottles warm or cold; durable quilted fabric; washable changing pad; a large storage pocket which can be utilized to store a large supply of diapers; and smaller pockets for items such as tweezers and nail clippers.

FIG. 1 shows a view of one embodiment of the present invention. Additionally, FIG. 2 shows an exploded view of the embodiment of the present invention shown in FIG. 1. The bed changing station/baby organizer is comprised of durable quilted fabric made in various colors (Ref: 8 and drawing). It can also be comprised of different fabrics such as leather, canvas, cotton, polyesters, etc. Ref 1 and changing station flap is placed in between a mattress and a box spring (box spring mattress optional) of a bed. Changing station Flap (Ref: 1) is uniquely designed to keep from slipping between mattress and box spring. Ref: 2, 7 are designed to keep items such as baby bottles warm/cool. Ref 3. Establishes where components should go. Ref: 4 are suggested for grooming tools but can be used in many different ways. Ref: 5, 9 represent the item name. Ref: 6, 13 suggest inserting diapers, wipes, lotion, accessories, and changing pad. Ref: 6, 13 can also be used to insert other items according to consumer. Ref. 17, is machine washable cloth that is used to change infant or toddler. Ref: 17, is conveniently made to insert in the changing pad pocket. Changing Station can be used in various ways.

The bed changing station/baby organizer station also includes multiple quilted pockets Ref: 6,13 sewn into the front of this embodiment. The pockets are made of a quilted material for both protection against breakage and insulation of hot/cold materials. The pockets may vary in size and number in other embodiments. The pockets may also have embroidered labels for identifying specific uses. The tops of the pockets may have elastic around the edge to help keep items from falling out. The embodiment shown also includes two separate insulated bottle holders Ref: 2,7 on each side of the station. The bottle holders are made of a quilted fabric with insulating materials in this embodiment. The present inventions also included semicircular loops Ref: 18 on each side of the main pocket for attaching a shoulder strap (not shown). This allows the station to double as a "on the go" baby changing station and organizational tool by adding the additional straps. The station may also include a changing pad Ref: 17 that are carried in the station. The changing pad may be made of a durable quilted fabric or waterproof quilted fabric and or other suitable material Ref: 8.

The materials used in the station are typically durable quilted fabric and/or waterproof quilted fabric and or/cloth material and fabric thread made and elastic. It can also be made of different fabrics such as leather, canvas, cotton, polyesters. The materials may also be machine washable. The quilted materials help protect and fragile supplies from breakage or damage as well as providing some insulation for temperature sensitive items.

The present invention is structured to have the elongated flap placed between mattress and box spring of mattress in a bed. The multifunction bed storage apparatus pockets are accessible at the edge of the mattress by someone in the bed. The multifunction bed storage apparatus station is held in place by the engineered elongated flap. The elongated flap was engineered for the allowance of heavier items to be placed in pockets without slipping out between mattress and box spring.

It should be clear that the dimensions and materials of the invention may be varied in different embodiments. The advantages of the present invention include the elongated flap that allows the multifunction bed storage apparatus to hold heavy products without slipping out between mattress and box spring and housed products can be easily reached from side of the bed. It helps mothers and or parents get organized when it comes to diapering and caring for their newborn or toddler.

While the invention has been described with respect to a limited number of embodiments, those skilled in the art, having benefit of this disclosure, will appreciate that other embodiments can be devised which do not depart from the scope of the invention as disclosed here. Accordingly, the scope of the invention should be limited only by the attached claims.

What is claimed is:

1. A multifunction bed storage apparatus for storing and organizing infant care supplies, comprising:

a multiple pocket storage compartment;

an engineered, elongated flap attached to the storage compartment, wherein the flap includes inserts constructed of non-slip foam or sponge material forming ribs;

wherein the flap is adapted to be pressed between the box spring and mattress of a bed, the flap and ribs preventing the storage apparatus and any heavy supplies contained therein from slipping out;

wherein the elongated flap is capable of use as a portable changing station to lay a baby down upon for changing;

wherein the storage compartment contains multiple labeled storage pockets;

wherein the storage pockets may have elastic openings;

wherein the storage compartment has insulated holders attached to each end of the storage compartment;

and wherein the storage compartment includes two loops attached to each end of the storage compartment, the loops being suitable for attaching to a carrying strap.

* * * * *